US005154256A

United States Patent [19]

Wood

[11] Patent Number: 5,154,256

[45] Date of Patent: Oct. 13, 1992

[54] SCAFFOLD GUARD POST AND LOCK

[75] Inventor: Charles F. Wood, Mississauga, Canada

[73] Assignee: Aluma Systems Corp., Downsview, Canada

[21] Appl. No.: 813,093

[22] Filed: Dec. 24, 1991

[51] Int. Cl.[5] ..... E04G 1/26

[52] U.S. Cl. ..... 182/113; 256/65; 403/49

[58] Field of Search ..... 182/113, 178, 179; 403/49; 256/59, 65

[56] References Cited

U.S. PATENT DOCUMENTS

| | | | |
|---|---|---|---|
| 2,708,607 | 5/1955 | Bingle | 403/49 |
| 2,960,335 | 11/1960 | Shuttleworth | 182/113 |
| 3,091,485 | 5/1963 | Jackson | 403/49 |
| 3,867,997 | 2/1975 | Hyslop | 182/113 |
| 4,039,264 | 8/1977 | Sharp | 403/49 |
| 5,070,965 | 12/1991 | Jordan, III | 182/113 |

FOREIGN PATENT DOCUMENTS

| | | | |
|---|---|---|---|
| 760884 | 12/1933 | France | 182/113 |

*Primary Examiner*—Reinaldo P. Machado

[57] ABSTRACT

A guard rail post assembly for a scaffolding platform advantageously uses an offset base portion to simplify connection of rail members at a point aligned above the base. A gravity lock is also disclosed which serves to maintain rail members which have been secured to the guard rail assembly and/or secure other connecting members elsewhere in scaffolding and shoring systems.

22 Claims, 6 Drawing Sheets

SCAFFOLD GUARD POST AND LOCK

FIELD OF THE INVENTION

The present invention relates to scaffolding systems and, in particular, to guard rail assemblies for scaffolding systems used to provide access for workmen or provide support as shoring.

BACKGROUND OF THE INVENTION

Many scaffolding systems are known and these systems all include guard rail posts which extend generally vertically from the scaffolding system and receive and engage rail members to provide a safety barrier. Typically, the guard rail posts are of a tubular upright and include, at three or four axial locations, a securing arrangement for engaging a rail or brace member. These prior art structures are quite complicated due to the number of fastening points and are also prone to damage during handling of the system.

There remains a need to provide a simplified system where the guard rail post is capable of receiving and engaging various rail members conveniently with reduced or without manual manipulation.

SUMMARY OF THE INVENTION

The guard rail post, according to the present invention, comprises a tubular upright member having a base portion and an upright portion offset relative to the base portion. The upright portion generally above the base portion has at least one rail engaging member sized for receiving and engaging the ends of two rails.

A guard rail post, according to the invention, comprises an upright having a base portion adapted to slip down over a connection of a scaffold with the base offset from an upper portion of the upright. The upper portion includes a rail engaging member aligned with the center line of the base. This rail engaging member so positioned is capable of engaging a number of rails at various angles to the guard post. The offset configuration simplifies securement of rail members and reduces the number of rail fastening members about a guard post. In a preferred form, the rail engaging member is generally vertical and the rails have a flat end with a circular port for placement on the generally vertical rail engaging member and pivotal thereabout.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
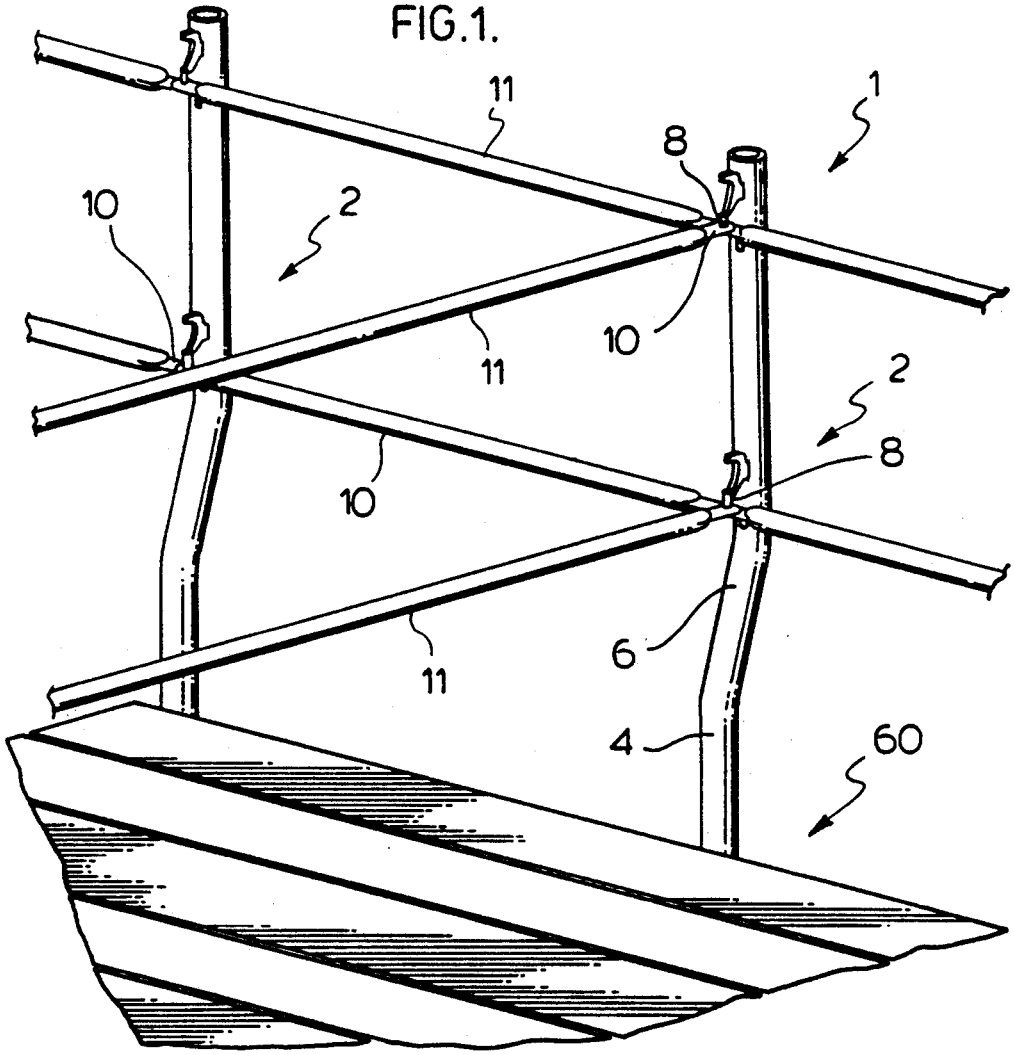
FIG. 1 is a partial perspective view showing the guard rail post and rail secured to a scaffold platform.

The guard rail assembly, generally shown as 1, is secured to the scaffold frame by means of a male connection at the upper edge of the frame which is normally used to stack another frame thereabove. The guard rail post merely sleeves over this male connection. The guard rail assembly 1 includes a tubular upright member, shown as 2, the base 4 of which slides over the male connection of the frame. The base 4 above the level of the scaffold platform 60 has an upper portion 6, which is offset to one side of the base 4. Rail engaging members 8 secure the flattened ends 10 of the rail members 11 by means of a port 13 provided in the flattened ends 10.

Figure 4:
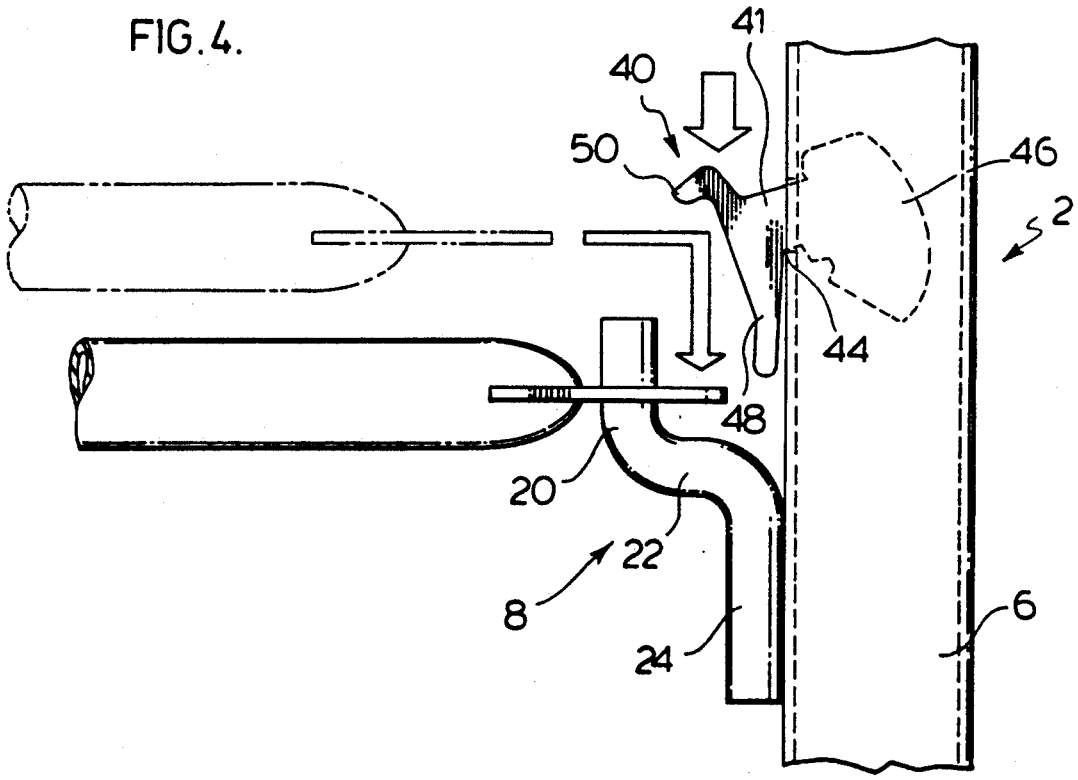
Figure 7:
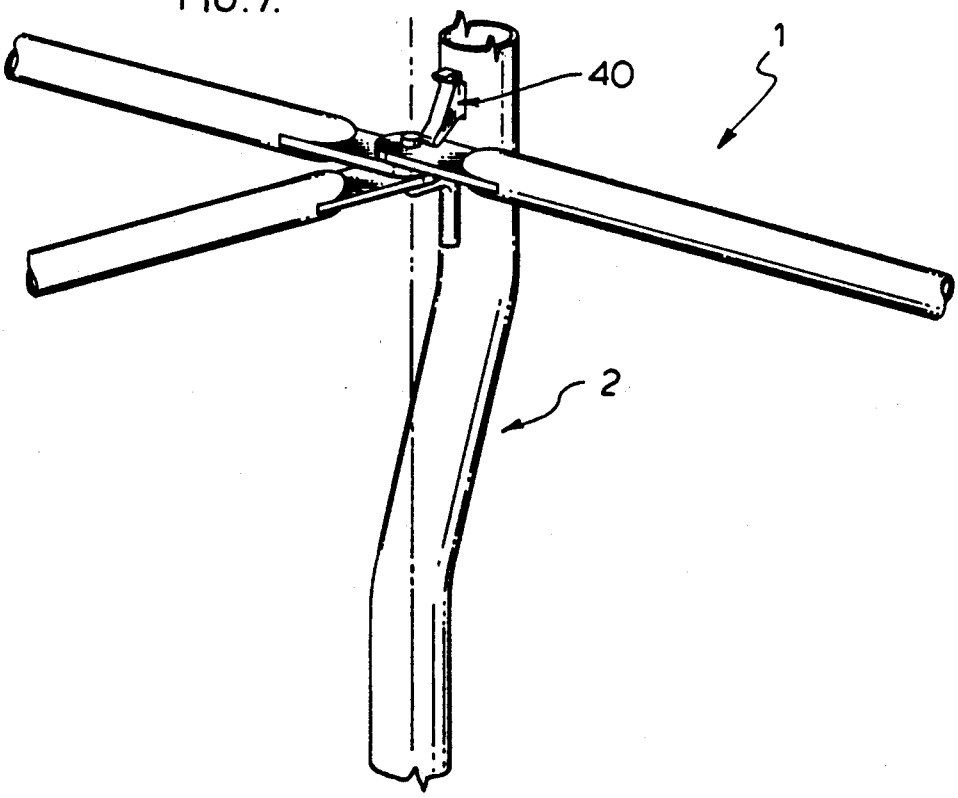
FIG. 7 is a perspective view of three guard rails secured on a guard rail post.

The rail engaging members 8 are attached to the upright portion 6 and, as shown in FIG. 4, have a leg 24 attached to the upper portion 6, a base 22 extending generally perpendicular to the upper portion 6, and a generally vertical bolt-like member 20 which is sized to cooperate with the ports 13 provided in the flattened end 10 of the rails 11. As perhaps best shown in FIG. 7, the bolt-like member 20 is aligned with the longitudinal axis of the base 4, which is made possible due to the offset of the upper portion 6. This arrangement allows the bolt-like member to align with the longitudinal axis of the base and provide clear access to the bolt-like member from a host of directions, as generally indicated in FIG. 7. With this arrangement the distance between bolt-like fasteners of adjacent guard rail assemblies is determined by the spacing of the scaffold frames to which the scaffold platforms are secured. Thus, the one bolt-like member 20 can receive and engage a number of flattened ends of the individual rail members 11.

As best shown in FIG. 1, there would be a number of aligned rail engaging members 8 secured to each guard rail post and it is preferred that a lock is provided for each rail engaging member 8 whereby accidental removal of the rails 11 is not possible. One such locking arrangement 40 is shown in the drawings which is a gravity lock, generally shown as 40, which is supported in slot 42 provided in the tubular upright 2. The movable locking member 41 is inserted through the slot in the upright member and is designed to pivot about the pivot point 44, which is the base of the slot 42.

Figure 3:
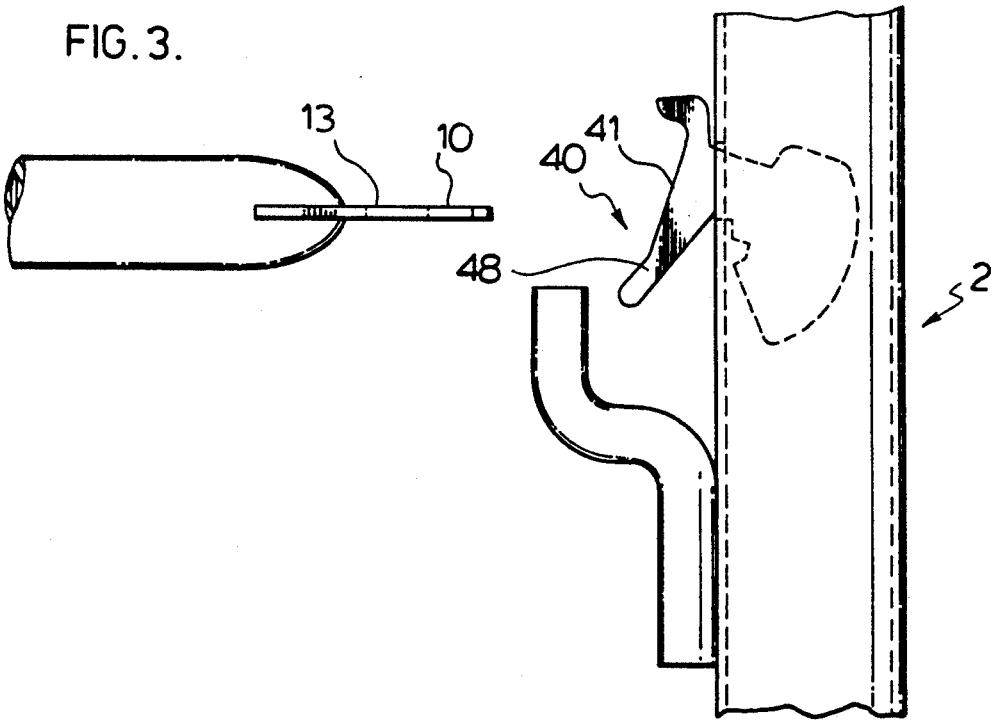
FIGS. 3, 4 and 5 show various steps in securing of guard rails to the guard rail post.
Figure 5:
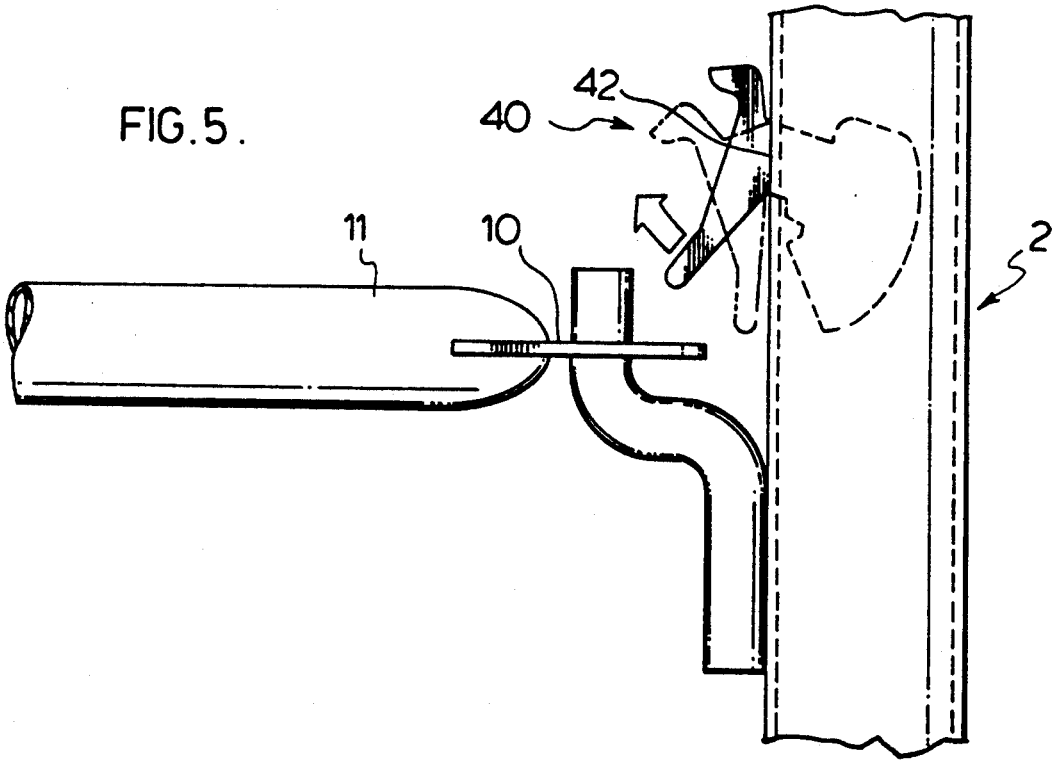
Figure 6:
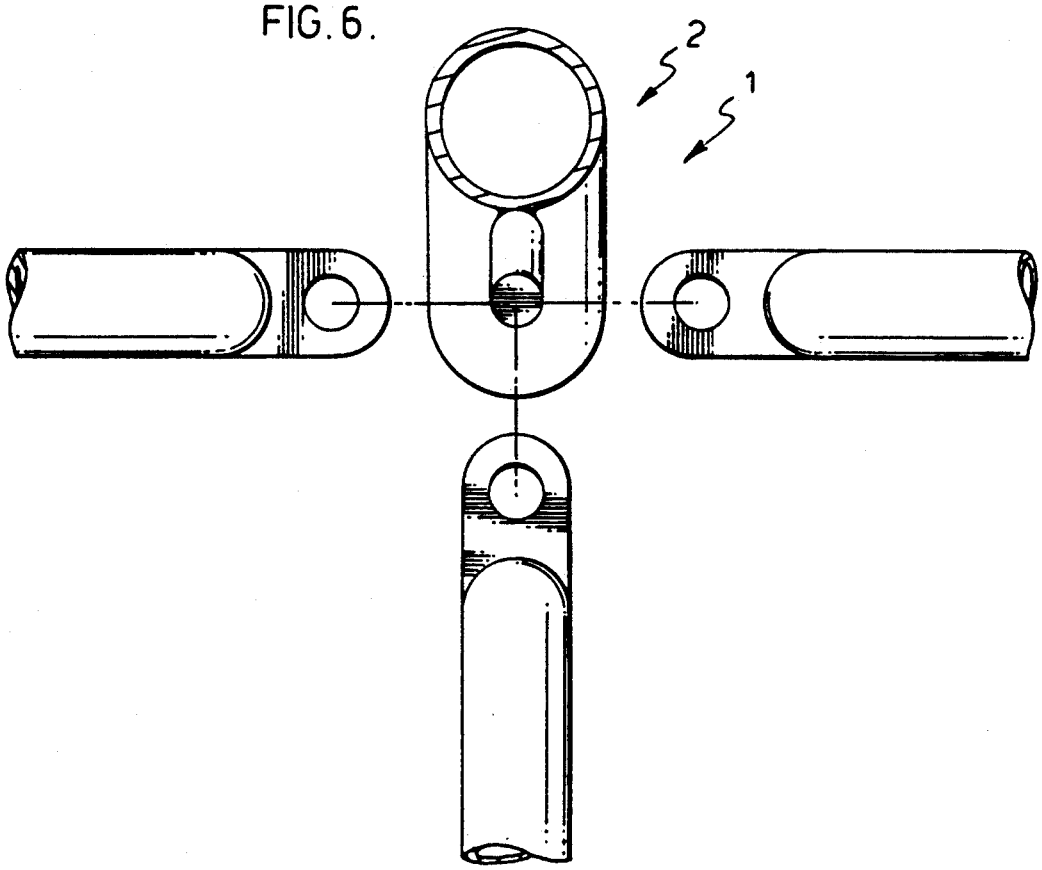
FIG. 6 is a top view of the guard rail post with the gravity lock not shown to clearly indicate the position of the guard rail fastening member.

For ease of insertion of the locking member 41 into the slot provided in the upright member, the locking member may be made in two parts. A counterbalanced leg 46 is provided interior to the tubular upright 2 and a locking leg 48 is positioned between the upright portion 2 and the interior edge of the bolt member 20. The counterbalanced leg 46 provides a bias urging the movable locking member 41 to the position, generally shown in FIG. 3. It can be seen that the locking leg 48 has its free end closely adjacent the interior edge of the bolt-like member 20 whereby accidental removal of a rail member is avoided. To secure a rail member on the bolt-like member 20, the flattened end 10 having the securing port 13 is aligned with the bolt-like member 20 and pushed downwardly, as indicated in FIG. 4. In this case, the gravity lock 40 is moved to allow insertion of the rail on the bolt member 20, either by the flattened end 11 forcing the gravity latch to the position of FIG. 4. Once the rail has been placed on the bolt-like member 20, the gravity latch returns to the locked position of FIG. 5 due to the gravity bias. In this position, the flattened end 10 of the rail member 11 cannot be inadvertently removed from the bolt-like member as the locking leg 48 is contacted with any upward movement of the flattened end 10 and the gravity lock at the upper edge engages and is limited by the tubular upright. Thus. the locking leg 48 serves to prevent inadvertent removal of a rail member in engagement with a rail engaging member 8.

Figure 2:
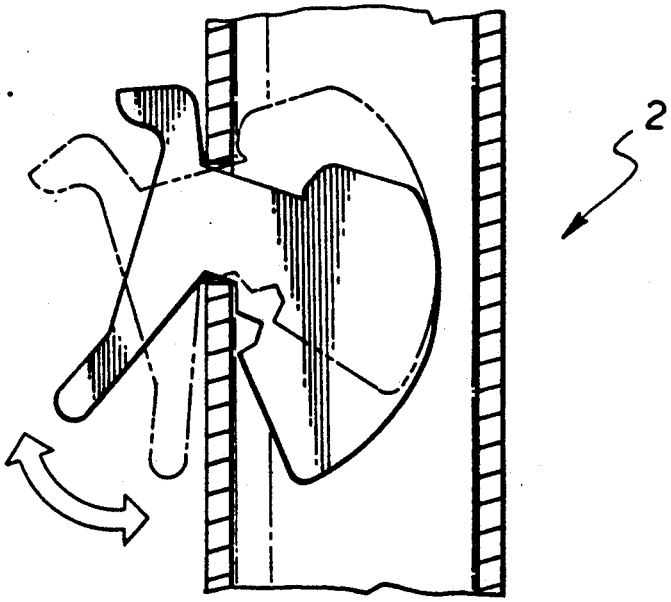
FIG. 2 is a sectional view through the guard rail post showing details of the gravity lock arrangement.
Figure 2A:
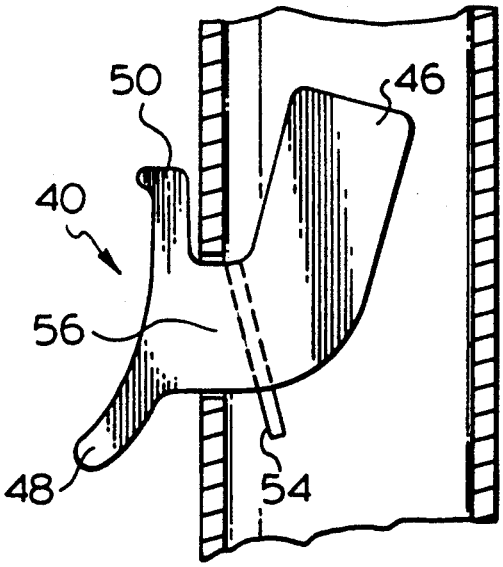

An alternate structure of the gravity latch is shown in FIG. 2*a*. In this case, the gravity latch 40 includes a locking pin 54 which passes through shank 56 and projects therebelow as indicated in the figure. The locking leg 48, the release stub 50, shank 56 and counterbalance leg 46 are preferably of a single extrusion which can be fed through slot 42. The locking pin 54 is then driven into the shank 56 by pulling the latch forward to allow the pin to be driven through the top hole in the shank to locate the lower portion of the pin interior to the post due to an angled port in the shank. The pin, once received in the shank, captures the latch in the desired relationship with the slot of the post. The pin can be removed by driving it completely through the shank should repair be required.

Rather than using the pin of FIG. 2*a*, the gravity latch could have an integral spring leg which is compressed when inserted through the slot. Once the spring leg clears the slot, it returns to a position which stops withdrawal of the latch from the slot while still accommodating the desired pivotting movement of the latch.

The gravity latches of FIG. 2 and 2*a* locate the counterbalance leg within the post where it is less susceptible to damage and the bolt like member 20 serves to protect the locking leg 48. This is important as the post will be subject to damage due to the frequent assembly, disassembly and shipping of the equipment.

Figure 8:
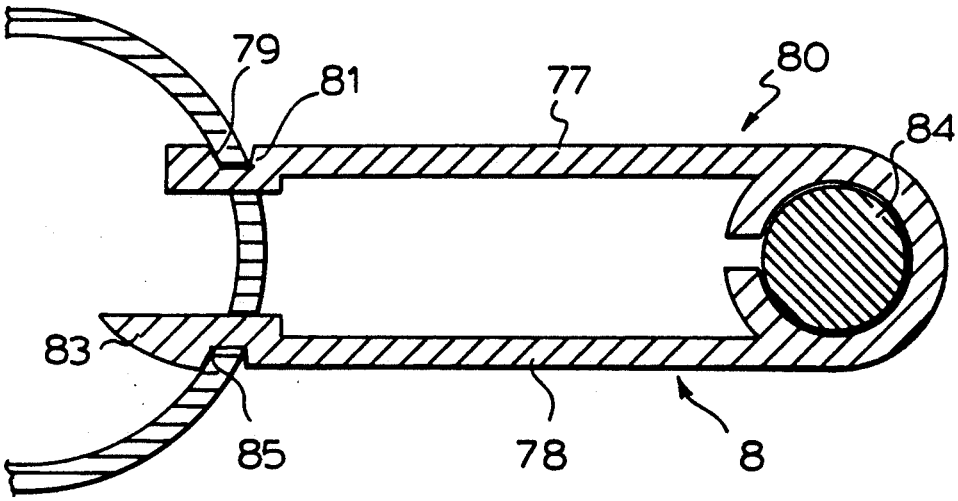
FIG. 8 is a cross section through a guard rail post showing securement of a member to the post.
Figure 9:
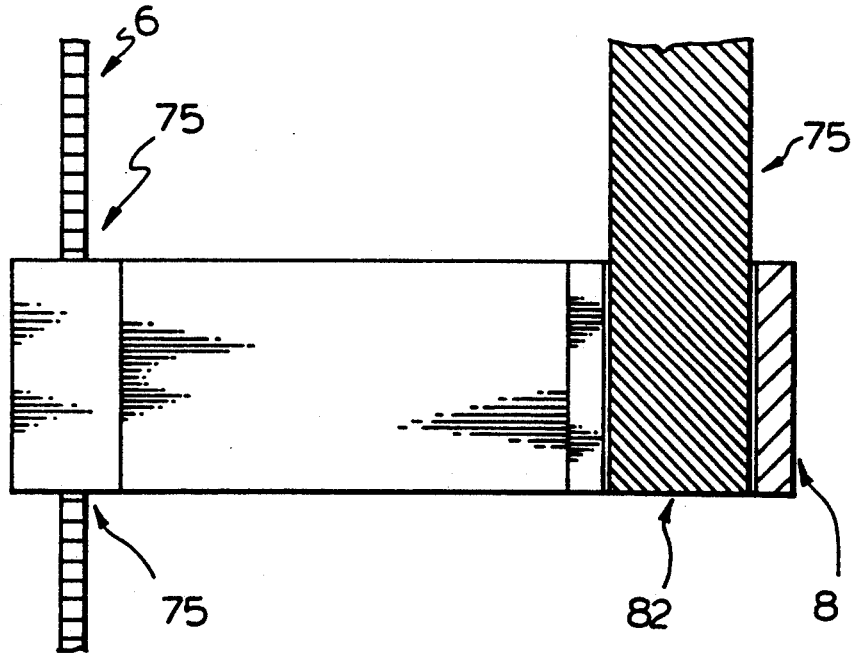
FIG. 9 is a side view of the securing arrangement of FIG. 8.

FIG. 8 shows a different arrangement for securing of a rail engaging member 8 to a guard rail post 6. In this case, the guard rail post 6 has been provided with a slot-like opening 75 into which opposed spring arms 77 and 78 of the fastener 80 are inserted. Between spring arm 77 and 78 is a bolt receiving port 82, in this case having a bolt 84 secured therein. As spring arms 77 and 78 are compressed together for initial insertion into the slot 75 and subsequently held in a compressed state by means of the post 6, a gripping engagement is accomplished on the bolt 84 received in the bolt port 82. In the unstressed state of the fastener 80, spring arm 77 and 78 are in a position substantially wider than that shown in FIG. 8. In this unstressed condition, the bolt 84 may easily be placed within the bolt port 82. Once so positioned, the fastener 80 then can then be attached to a post 6 by first inserting end 79 having slot 81 into slot 75 of the post, with one wall of the upright 6 engaged within the slot 81. Spring arm 78 is then moved towards arm 77 either by a mechanical tool or possibly hydraulically such that the end 83 of the arm 78 can be inserted through slot 75 such that slot 85 engages the other side of the slot 75. The slot is sized to provide a close relationship top and bottom of the fastener 80. In this way, there is a very positive engagement of the fastener 80 within the post 6 and the bolt 84 has been firmly engaged due to the movement of the spring arms and retention of the spring arms within the slot 75. One advantage with this system is that the bolt is perpendicular to the ends of the spring arms 77 and 78 and there is no curve section as shown with respect to the member of FIG. 4. In light of this, the guard rails can bottom out against the ends of the spring arms 77 and 78 and do not bind against a circular section. This simplifies insertion and removal of guard rails from the bolt 84.

It can be appreciated from the above that the structure of the tubular leg has been simplified. in that one fastening point is satisfactory for engaging a number of rail members while still positioning the end of the rail members directly above the base and aligned with the frame. In this way, the rail members may be of an identical length and substituted, one for the other. It is also possible to use a single locking arrangement for engaging all of the individual rail members. As can be seen in FIG. 7, a "T" type configuration of the rail members is easily possible while still maintaining the center line distance between the individual rail members.

The gravity latch or lock 40 has been described relative to the securing of rail members, but is is possible to use this gravity lock for securing of other connecting members elsewhere in scaffolding and shoring systems.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A guard rail post comprising an upright having a base portion adapted to be received by a connection with said base offset from an upper portion of said upright, said upper portion including a rail engaging member generally aligned with the vertical axis of said base.

2. A guard rail post as claimed in claim 1 wherein said upper portion includes one or more rail engaging members aligned in the longitudinal direction of said upright.

3. A guard rail as claimed in claim 2 wherein said rail engaging member includes a base extending outwardly from said upper portion and a bolt-like member extending upwardly from said base.

4. A guard rail as claimed in claim 3 including a rail locking arrangement which cooperates with said upper portion to releasably lock rail members when rail members are secured on said bolt-like member.

5. A guard rail member as claimed in claim 3 wherein said rail engaging member includes a leg portion which forms an extension of said base opposite said bolt-like member, said leg being attached along its length to said upper portion.

6. A guard rail post as claimed in claim 5 including a gravity lock secured to said upper portion and positioned to, in combination with said bolt-like member, releasably lock rail members which are in engagement with said bolt-like member, said gravity lock being biased to a closed position.

7. A guard rail post as claimed in claim 6 wherein said gravity lock is partially retained within said upright which is tubular.

8. A guard rail post as claimed in claim 6 wherein said tubular upright is slotted opposite said bolt-like member for receiving said gravity lock and forming a pivot connection therewith with said gravity lock partially retained within said upright.

9. A guard rail post as claimed in claim 8 wherein said gravity lock is "U" shaped with one arm of the "U" shape within the tubular upright and the other arm exterior thereto.

10. A guard rail post comprising a tubular upright having a base portion and an upper portion offset relative to said base portion. said upper portion generally aligned above said base portion has at least one rail engaging member sized for receiving and engaging the ends of rails whereby the point of attachment of the rails to the rail engaging member is aligned with said base portion.

11. A guard rail post as claimed in claim 10 wherein said upright portion includes two rail engaging members aligned in the longitudinal direction of said upright.

12. A guard rail as claimed in claim 11 wherein said rail engaging member includes a base extending outwardly from said upper portion and a bolt-like member extending upwardly from said base.

13. A guard rail as claimed in claim 12 including a rail locking arrangement which cooperates with said upper portion to releasably lock rail members when rail members are secured on said bolt-like member.

14. A guard rail member as claimed in claim 12 wherein said rail engaging member includes a leg portion which forms an extension of said base opposite said bolt-like member, said leg being welded along its length to said upper portion.

15. A guard rail post as claimed in claim 14 including a gravity lock secured to said upper portion and positioned to, in combination with said bolt-like member, releasably lock rail members which are in engagement with said bolt-like member, said gravity lock being biased to a closed position.

16. A guard rail post as claimed in claim 15 wherein said gravity lock is partially retained within said upright and said base of said guard rail post is sized to sleeve a male connection at the upper portion of a scaffold frame.

17. A guard rail post as claimed in claim 15 wherein said tubular upright is slotted opposite said bolt-like member for receiving said gravity lock and forming a pivot connection therewith.

18. A guard rail post as claimed in claim 17 wherein said gravity lock is "U" shaped with one arm of the "U" within the tubular upright and the other arm exterior thereto.

19. In a scaffolding system having a number of guard rail posts spaced in the length of said scaffolding system, each guard rail post having a base portion and a tubular upright portion offset relative to said base portion and a rail engaging member generally directly above said base portion such that the point of connection of rail members in engagement with said rail engaging member is directly above said base portion and offset relative to said tubular upright portion.

20. In a scaffolding system as claimed in claim 19 wherein said tubular upright portion opposite said rail engaging member includes a gravity lock pivotally connected to said upright portion which must be biased to an open position to release rail members in engagement with said rail engaging member.

21. In a scaffolding, shoring or construction forming system, a structural connecting member used to releasably engage other components, said structural connecting member including opposed spring arms having wall engaging slots at a distal end for engaging a support slot of a structural component, said structural connecting member having said wall engaging slots of said spring arms engaging said support slot and locking therewith, said spring arms being maintained in a stressed state by said slot limiting outward movement of said arms which would reduce the stress therein.

22. In a system as claimed in claim 21 wherein said spring arms cooperate to form a pin engaging port and a pin is received in said port and maintained therein due to the stressed state of said arms.

* * * * *